US007649357B2

(12) United States Patent
Hunziker et al.

(10) Patent No.: US 7,649,357 B2
(45) Date of Patent: Jan. 19, 2010

(54) SIDE ENTRY LEAK PROTECTION FOR DOWNHOLE TOOLS

(75) Inventors: James C. Hunziker, New Caney, TX (US); Borislav J. Tchakarov, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 41 days.

(21) Appl. No.: 11/417,418

(22) Filed: May 4, 2006

(65) Prior Publication Data

US 2006/0273799 A1 Dec. 7, 2006

Related U.S. Application Data

(63) Continuation-in-part of application No. 10/635,250, filed on Aug. 6, 2003, now abandoned.

(51) Int. Cl.
*G01V 3/18* (2006.01)
*E21B 17/00* (2006.01)

(52) U.S. Cl. ..... 324/347; 175/320

(58) Field of Classification Search ..... 324/323–325, 324/332–375; 175/320, 40; 166/65.1
See application file for complete search history.

(56) References Cited

U.S. PATENT DOCUMENTS

| | | | | | |
|---|---|---|---|---|---|
| 4,278,942 | A * | 7/1981 | Bonnet et al. | ..... | 324/347 |
| 4,286,217 | A * | 8/1981 | Planche et al. | ..... | 324/347 |
| 5,065,825 | A * | 11/1991 | Bardin et al. | ..... | 175/38 |
| 5,389,003 | A * | 2/1995 | Van Steenwyk et al. | ..... | 439/191 |
| 5,661,402 | A * | 8/1997 | Chesnutt et al. | ..... | 324/338 |
| 5,677,631 | A * | 10/1997 | Reittinger et al. | ..... | 324/324 |
| 6,123,561 | A * | 9/2000 | Turner et al. | ..... | 439/194 |
| 6,609,567 | B2 * | 8/2003 | Ingram et al. | ..... | 166/126 |
| 2004/0104047 | A1 * | 6/2004 | Peter | ..... | 175/40 |

* cited by examiner

*Primary Examiner*—Kenneth J Whittington
(74) *Attorney, Agent, or Firm*—Mossman Kumar & Tyler PC

(57) ABSTRACT

A connector for a downhole tool includes a body with one or more conductors positioned at least partially axially adjacent to an axial bore that extends at least partially through the body. In embodiments, one or more seals surrounding the body prevent fluid from flowing from a lateral opening into the interior of the downhole tool. Additionally, the body of the connector can include a circumferential or annular recess that acts as a reservoir to contain or capture fluid that might otherwise enter the sub. Leak protection can also be protected by applying a pressure compensating material around the body.

25 Claims, 4 Drawing Sheets

SIDE ENTRY LEAK PROTECTION FOR DOWNHOLE TOOLS

CROSS-REFERENCE TO RELATED APPLICATIONS

This application is a continuation-in-part of U.S. patent application Ser. No. 10/635,250, filed on Aug. 6, 2003, now abandoned titled "Side Entry Leak Protection for Sondes."

BACKGROUND OF THE INVENTION

1. Field of the Invention

The invention relates generally to the design and construction of electrical connections for use in sondes and other wellbore logging tools. In particular aspects, the invention provides devices and methods for improved packaging of electrically conductive elements within such a tool and for protecting said elements against wellbore fluids.

2. Description of the Related Art

A number of tools are known today for logging or sensing conditions within a wellbore during various portions of the well productions process. These sensing tools, or sondes, include an outer casing or sub that is often disposed into a wellbore on wireline. Alternatively, the sub may be disposed into the wellbore on coiled tubing or as part of the drill string or even production tubing. The sensing tools are capable of detecting a wide variety of downhole conditions, including temperature, pressure, porosity, resistivity, and so forth. The sensing tool generally features a sensor disposed on the outer side surface of the sub or embedded therewithin the side surface. Electronic equipment is disposed within the interior of the sub, and is typically contained within compartments behind sealed bulkheads that are located proximate each axial end of the sub. This electronic equipment typically includes processing circuitry, storage media, and power sources.

Fluid sealing is provided around the sensor to prevent entry of fluid into the interior of the sub. If damaged, however, the seal may permit fluid to flow into the interior of the sub. A typical external environment for a sonde would be one where the wellbore fluid is at a pressure state that higher than the interior of the sub. The pressure difference may range from 50 psi to 30,000 psi. Once inside the sub, the fluid may corrode or otherwise destroy the conductivity of the wiring that extends between the sensor and the components housed within the two axially-located chambers. Additionally, if either of the bulkheads are breached, the intruding fluid might easily destroy the electronic components housed within. Additionally, present techniques for constructing sondes with bulkheads and the necessary bulkhead electrical connectors are time consuming and costly.

The present invention addresses the problems of the prior art.

SUMMARY OF THE INVENTION

In aspects, the invention provides devices and methods for construction of a downhole tool such as a sonde or other sensing tool that includes a side-entry leak protector connector arrangement. The side-entry leak protector connector provides for improved fluid sealing against fluid that might enter a tool proximate the side-mounted device such as a sensor component. An exemplary side entry leak protector connector assembly is described having a body that is secured within a passage within the sub between a shoulder and a retaining member such as a snap ring. The body can be formed of polyethyl-ether-keytone, a metal, a composite or other suitable material. The side entry leak protector connector assembly includes glass-sealed conductive elements and pin connectors to operably engage mating electrical connections leading to an external device such as sensors, the components housed within the sub or elsewhere in the downhole tool.

In other aspects, the present invention provides features that reduce the risk of wellbore fluid invading the interior of the downhole tool. For instance, the connector body can be surrounded by one or more seals that prevent fluid invasion from a lateral opening in a downhole tool. In one embodiment, the seal or seals are configured to withstand a pressure difference between an atmospheric pressure in the downhole tool and an external wellbore pressure. Additionally, the body of the protector connector can include an annular fluid chamber that acts as a reservoir to contain or capture fluid that might enter the sub. Leak protection can also be provided by applying a pressure compensating material around the body. It should be appreciated that embodiments of the present invention eliminate the need for interior bulkheads within the sub.

Embodiments of the present invention also provide enhanced functionality for the downhole tool. For example, the connector can include a body having an axial bore that extends partially or fully through the body. One or more conductors run axially along and adjacent to the axial bore. Advantageously, the axial bore can be configured to perform any number of functions such as acting as a conduit that receives data conducting elements or as a hydraulic conduit for receiving fluid. Another suitable bore configuration includes a cavity that houses downhole devices such as circuitry, batteries, or processors. Yet another suitable bore configuration is an access conduit through which one or more manipulable members such as wires, cables, and linkages can extend.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE PREFERRED EMBODIMENTS

Figure 1:
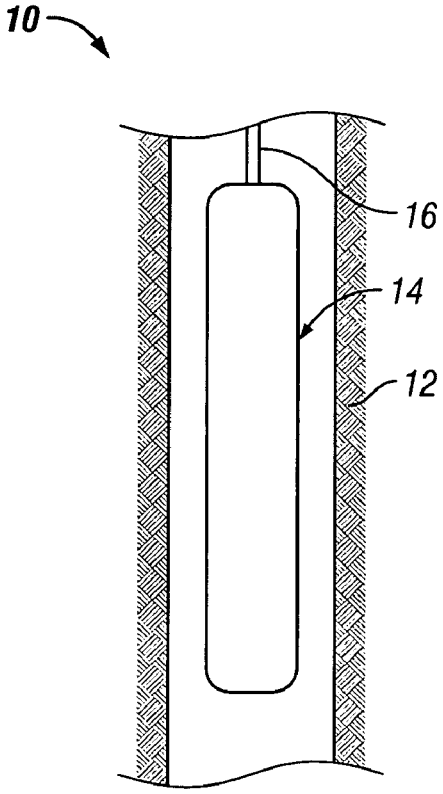
FIG. 1 depicts an exemplary wireline-run tool within a wellbore.

The present invention relates to devices and methods for providing connection and sealing arrangements for downhole tools. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

FIG. 1 schematically illustrates a downhole portion of a wellbore 10 that is disposed through earth 12. A sonde 14 is suspended upon a wireline running arrangement 16 within the wellbore 10, which also contains a variety of fluids to which the sonde 14 will be exposed. While a wireline arrangement is shown, other conveyance devices such as slicklines, drill pipe or coiled tubing can also be used. The sonde 14 may be configured to detect any of several downhole conditions or parameters of interest, including resistivity, porosity, pressure, temperature, and so forth. The sonde 14 is shown in cross-section in FIG. 2. The sonde 14 has a tubular outer housing 18 which defines a pair of chambers 20, 22 which are located proximate each axial end 24, 26, respectively. An axial passage 28 extends between the two chambers 20, 22. The axial passage 28 includes a shoulder 30. A lateral opening 32 interconnects the axial passage 28 to the radial exterior of the sonde 14.

Electronic equipment 34 is contained in each of the chambers 20, 22. The electronic equipment 34 may include processing circuitry, power sources, storage media or the like. Additionally, a sensor 36 for detecting a downhole condition is mounted on the exterior of the housing 18 and provides an electrical pin connector 38 that is disposed within the lateral opening 32. It should be understood that the sensor 36 is merely representative of any device positioned on or external to the downhole tool 14.

Figure 2:
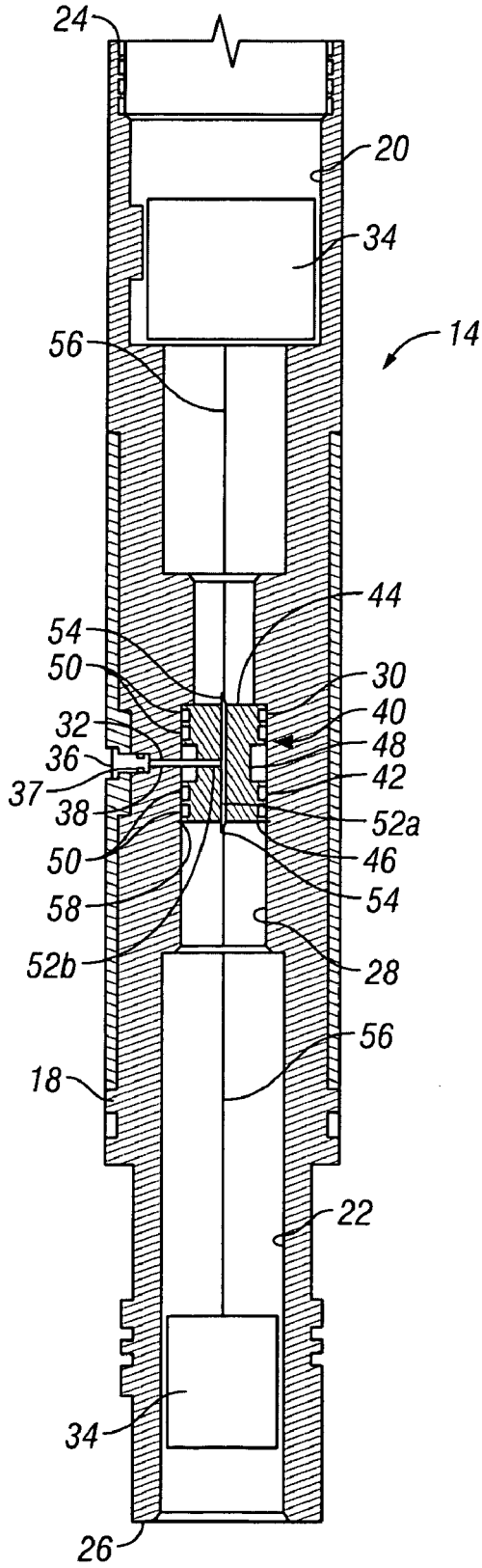
FIG. 2 is a cross-sectional view of an exemplary tool, which incorporates one embodiment of a side entry leak protector connector assembly constructed in accordance with the present invention.
Figure 2A:
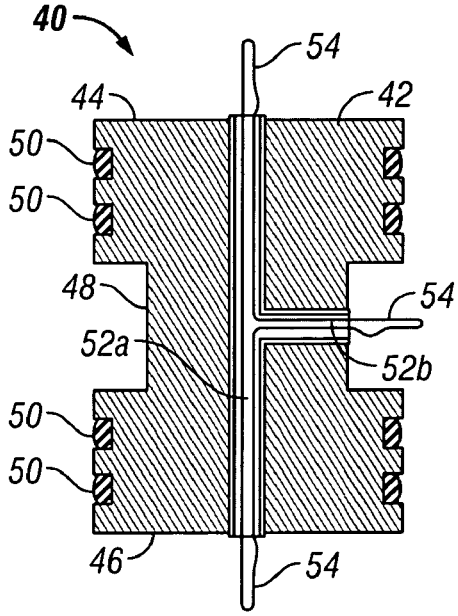
FIG. 2A is an enlarged cross-sectional view of one embodiment of a side entry leak protector connector assembly shown apart from other components.

A side entry leak protector connector assembly is shown generally at 40 in FIG. 2. FIG. 2A depicts the side entry leak protector connector assembly 40 in greater detail and apart from other components of the sonde 14. The protector connector assembly 40 includes a body 42 that is generally cylindrical in shape, having two axial ends, 44, 46. A circumferential channel 48 surrounds the body 42 at a central point along its length. A pair of O-ring seals 50 is located on either side of the channel 48 to form a barrier that against fluid leaking from the channel 48 into the interior areas of the tool 14. Fixedly retained with the body 42 are glass sealed conductive elements 52*a* and 52*b* with external pin-type electrical connectors 54. As FIG. 2A shows, the glass sealant 53 surrounds each of the elements 52*a*, 52*b* and fills the interstitial spaces between the elements 52*a*, 52*b* and the metallic body 42. FIG. 2A also illustrates the presence of pin-type electrical connectors 54 that project outwardly from the body 42. In FIGS. 2 and 2A, there are two conductive elements 52*a*, 52*b* shown. However, the number and arrangement of conductive elements will depend upon the number of electrical connections to be made by the protector connector assembly. The first conductive element 52*a* extends axially through the body 42 and the second element 52*b* extends radially outwardly from the first conductive element 52*a*. The second conductive element 52*b* engages the electrical pin connector 38 for the sensor 36. Meanwhile, the pin type connections 54 of the first conductive element 52*a* are electrically connected to wires 56 that interconnect the protector connector assembly 40 with the electrical equipment 34 in each of the chambers 20, 22. The body can be formed of polyethyl-ether-keytone, a metal, a composite or other suitable material.

The protector connector assembly 40 resides within the axial passage 28 so that one axial end 44 of the protector connector assembly 40 abuts the shoulder 30 of the passage 28. A snap ring 58 retains the protector connector assembly 40 within the passage 28.

In operation, the side entry leak protector connector assembly 40 provides superior prevention of and protection against fluid that might enter the housing 18 via the lateral opening 32. The circumferential channel 48 contains any fluid that might enter the lateral opening 32. In addition, the 0-ring seals 50 provide a secondary seal against fluid ingress past the protector 40 and into the chambers 20, 22. This eliminates or reduces the need for bulkheads to be constructed within the housing 18 to seal off the chambers 20, 22 from the axial passage 28. Additionally, the glass-sealing of the conductive elements 52*a*, 52*b* within the body 42 prevents damage to the conductive elements 52*a*, 52*b* from borehole fluids.

Figure 3:
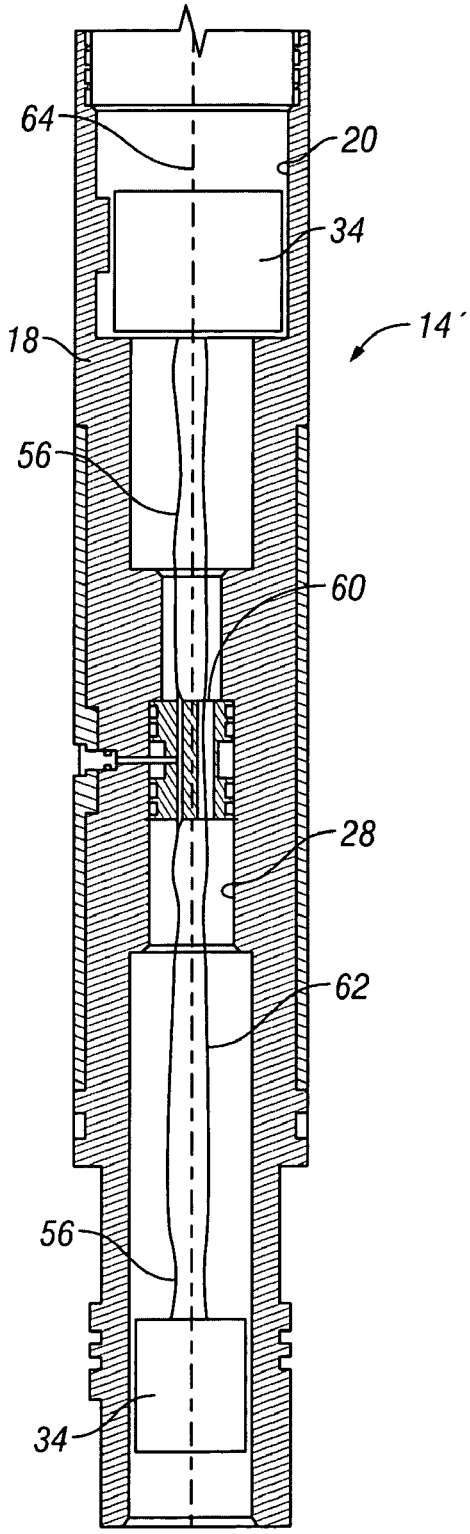
FIG. 3 is a cross-sectional view illustrating a tool with an alternate embodiment of a side leak protector connector assembly constructed in accordance with the present invention.

FIG. 3 illustrates a further sonde 14' that contains an alternative leak protector connector assembly 40'. The leak protector connector assembly 40' differs from the leak protector connector assembly 40 by the inclusion of an axial passage 60 through which wiring or cables 62 may be disposed. It is noted that the axial passage 28 is mounted off-center within the housing 18 of the sonde 40' so that the central axis of the passage 28 is not coincident with the axis 64 of the housing 18. The wiring 62 is used to interconnect the electronic equipment 34 in each of the two chambers 20, 22. The sonde 14" is typically used where also wires 62 are required for application in between modules of tool string. In that instance, the wires 62 would merely extend beyond the axial ends 24, 26 of the housing 18 to neighboring modules (not shown).

Figure 4:
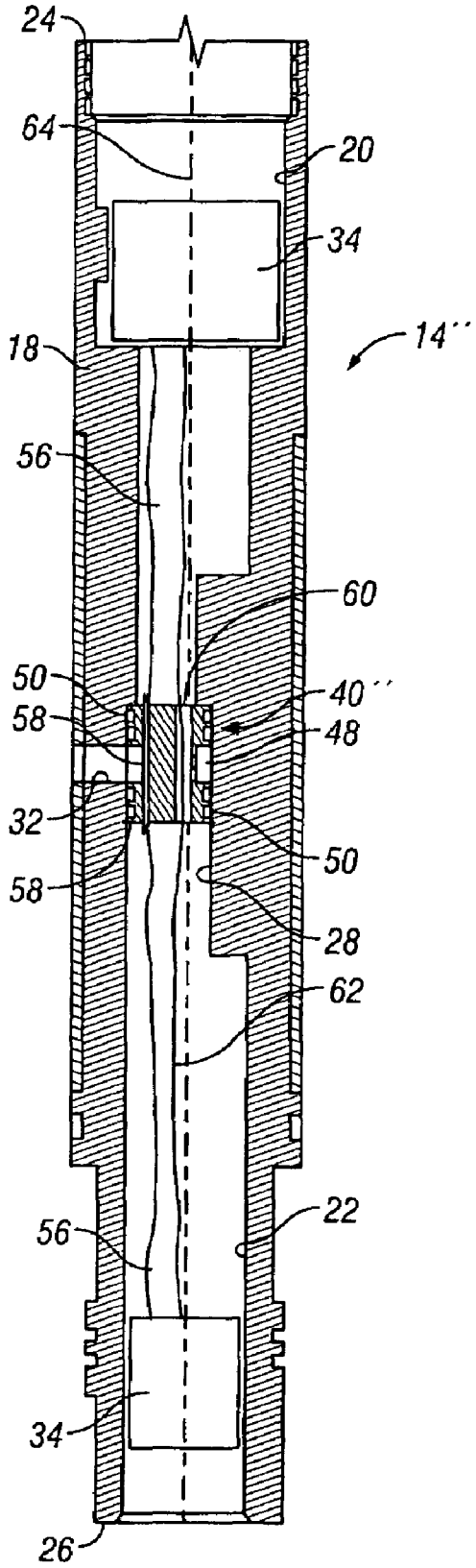
FIG. 4 is a side-cross sectional view of a further alternate embodiment of a side leak protector connector assembly in a tool.

FIG. 4 depicts a further alternative sonde 14" which also incorporates a side entry leak protector connector assembly 40" in accordance with the present invention. In this arrangement, the protector connector assembly 40" carries a direct contact electrode 58 that is exposed to wellbore fluids through the lateral opening 32. A direct contact electrode is used in a number of sondes, including an induction tool. It is noted that, in this embodiment, the opening 32 is not blocked or sealed against entry of fluids. The electrode 58 is positioned within and upon the circumferential channel 48 so that fluid entering the opening 32 will reside within the channel 48. The o-ring seals 50 on each side of the channel 48 block fluid passage from the channel 48 into the axial passage 28. This particular embodiment is useful where the sonde 14" is a larger diameter sonde or where it is desired to position the direct contact electrode 58 very proximate the outer radial diameter of the housing 18. Because the side entry leak protector assemblies 40, 40' and 40" can be used for both small and large diameter sondes, they can be economically manufactured in a single size and interchangeably used in sondes of different diameters.

Figure 5:
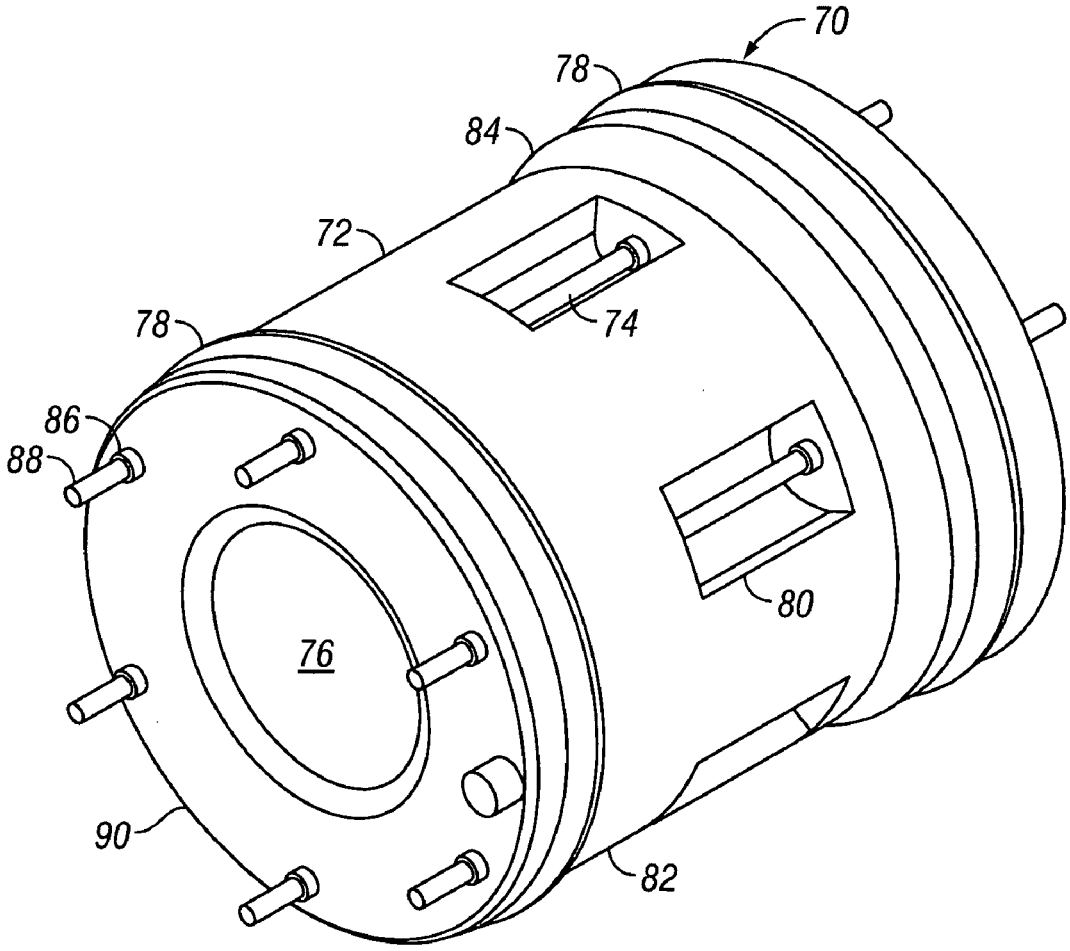
FIG. 5 is an isometric view of yet another embodiment of a connector made in accordance with the present invention.

Referring now to FIG. 5, there is shown another embodiment of a connector 70 having enhanced resistance to wellbore fluid invasion. Merely for convenience, the connector will be discussed with reference to FIG. 2. Referring now to FIGS. 2 and 5, in one application, the connector 70 is positioned in an axial passage 28 of a suitable downhole tool 14'. The connector 70 is also positioned adjacent a lateral opening 32 that leads to an exterior device such as a sensor 36. The exterior device 36 can include one or more seal elements 37 that prevent or limit the flow of fluid through the lateral opening 32. As will become apparent, the connector 70 establishes a connection to the exterior device 36 in a manner that preserves flexibility in the design of a downhole tool and reduces the risk of fluid entering the downhole tool 14' via the lateral opening 32.

In one embodiment, the connector 70 has a body 72 that includes one or circumferentially arrayed conductors 74 and one or more axial bores 76. In one arrangement, the conductors 74 and the axial bore 76 run substantially parallel along the body 72. It should be appreciated that this parallel arrangement provides the connector 70 with a plurality of transmission paths or conduits, each of which can be adapted to perform the same function or different functions. For example, the conductors 74, which can include metal wires or optical fibers and suitable terminals, can transmit power, data signals, and/or command signals. The axial bore 76 can also include conductors adapted to convey power, data signals or command signals. However, the axial bore 76 can also be utilized as a hydraulic conduit that transfers pressure pulses or allows fluid flow across the body 72. In still other variant, the axial bore 76 can be formed as an access way for receiving beams, linkages, cables, wires or other members that can be manipulated. In still another variant, the axial bore 76 can be formed to house or otherwise accommodate devices such as electrical components, circuitry, batteries or other equipment.

As noted above, the connector 70 is in part configured to contain or arrest fluid leaks through the opening 32. Such fluid leaks can occur if the seal elements 37, if present, fail or for some other reason wellbore fluid flows through the opening 32. In one embodiment, the body 72 includes one or more seal elements 78 that form a fluid barrier between the body 72 and the downhole tool 14'. For example, one or more seal elements 78 can be positioned uphole and downhole of the opening 32. In an exemplary arrangement, the seal elements 78 are configured to maintain a fluid barrier in an environment wherein the exterior pressure is wellbore pressure and the pressure inside the tool 14' is approximately atmospheric. Thus, the seal elements 78 can form a primary or a secondary barrier against fluid invasion into the interior of the tool 14'

In one arrangement, the body 72 has one or more windows or access openings 80 through which wiring running from the exterior device 36 can connect with the conductors 74. The access opening 80 exposes the conductor 74 to allow a splice into the conductor or to access to a take-out or other suitable terminal for forming a connection to the conductor 74. Additionally, an annular groove or recess 82 can optionally be formed on an outer surface 84 of the body 72. In a manner previously described, the recess 82 can function as a reservoir that retains fluid entering through the lateral opening 32 and prevents or at least limits such fluid from entering the interior of the tool 14'. Also, optionally, a pressure compensating material can be applied around the body 72 for further protection against fluid leaks. For example, a pressure compensating material can be applied the access openings 80 and/or the recess 82 to further function to prevent fluid leaking into the tool 14'.

It should be understood that the several features and aspects discussed in connection with FIG. 5 can be interchangeably used with any of the embodiments shown in FIGS. 1-4 and vice versa. For instance, as previously discussed, the conductors 74 can be glass sealed and embedded in the body 74 or run through bores formed in the body 72. Also, to further enhance electrical isolation and to reduce the risk of shorts from conditions such as condensation, the conductors 74 can include raised tabs 86 that surround a portion of pins 88 associated with the conductors 74 that project out of the body 72. Additionally, the connector 70 can be fixed within the axial passage 28 by abutting one axial end 90 of the connector 70 against the shoulder 30 of the passage 28 and installing a snap ring 58.

In practice, the arrangements of the present invention provide for superior leak protection as well as ease of establishing electrical connectivity between sensors and electrical components 34 that are housed within the sonde housing or in neighboring housings.

Those of skill in the art will recognize that numerous modifications and changes may be made to the exemplary designs and embodiments described herein and that the invention is limited only by the claims that follow and any equivalents thereof.

What is claimed is:

1. A downhole tool, comprising:

a housing having an axial bore and a lateral opening connecting the axial bore to an exterior of the housing, the lateral opening forming a leak path for a wellbore fluid exterior to the housing;

a body having an axial bore that runs through the body from one axial end to the other axial end of the body, the body being positioned in the axial bore of the housing, wherein the body includes a first end, a second end, and an opening between the two ends, at least one conductor positioned in the body and at least partially axially adjacent to the axial bore, the at least one conductor being connectable with a device external to the downhole tool, wherein the at least one conductor has an exposed portion at the opening;

a conductive element positioned in the lateral opening and connected to the at least one conductor.

2. The tool of claim 1, wherein the body is a ring-shaped member.

3. The tool of claim 1, wherein the axial bore of the body is one of (i) a conduit receiving data conducting elements, (ii) a hydraulic conduit, (iii) a cavity receiving a downhole device, and (iv) a conduit receiving a manipulable member.

4. The tool of claim 1 further comprising a pressure compensating material disposed around the body.

5. The tool of claim 1, further comprising a pressure compensating material disposed in an annular space formed on the body.

6. The tool of claim 1 further comprising a first seal positioned downhole of the lateral opening in the downhole tool and a second seal positioned uphole of the lateral opening, the first and the second seal being configured to contain fluid that leaks through the lateral opening.

7. The tool of claim 6, wherein the at least one seal is configured to withstand a pressure difference between an atmospheric pressure in the axial bore of the housing and an external wellbore pressure.

8. The tool of claim 1, wherein the at least one conductor is glass sealed and electrically isolated from the downhole tool.

9. The tool of claim 1, wherein the body seats between an interior shoulder formed in the downhole tool and a retaining element connected to an interior surface of the downhole tool.

10. The tool of claim 1, wherein the body is at least partially formed of polyethyl-ether-keytone.

11. The tool of claim 1, wherein the at least one conductor has a tab extending out the body and further comprising a raised portion at least partially surrounding the tab.

12. The tool of claim 1, wherein the opening is aligned laterally relative to the axial bore of the body.

13. The tool of claim 1, further comprising a plurality of circumferentially arrayed openings.

14. The tool of claim 1, further comprising at least one connector projecting from the body, and wherein the at least one conductor is connected to the at least one connector.

15. The tool of claim 1, wherein the at least one conductor conducts one of (i) data and (ii) power between the two ends of the body.

16. A method of forming a connection in a downhole tool, comprising:

forming a housing with an axial passage and a lateral passage connecting the axial passage with an exterior of the housing, wherein the lateral passage forms a leak path for a wellbore fluid exterior to the housing;

forming a body having an axial bore that runs from one axial end to the other axial end of the body;

positioning at least one conductor in the body and at least partially axially adjacent to the axial bore;

forming an opening in the body to expose a portion of the at least one conductor;

disposing the body in the axial passage of the down hole tool;

coupling the at least one conductor to a device positioned exterior to the downhole tool with a conductive element in the lateral passage.

17. The method of claim 16, wherein the body is formed as a ring-shaped member.

18. The method of claim 16 further comprising forming the axial bore as one of (i) a conduit receiving data conducting elements, (ii) a hydraulic conduit, (iii) a cavity receiving a downhole device, and (iv) a conduit receiving a mechanical linkage.

19. The method of claim 16 further comprising disposing a pressure compensating material at least partially on the body.

20. The method of claim 16 further comprising positioning a first seal downhole of the lateral passage in the downhole tool to the axial passage; positioning a second seal uphole of the lateral passage; and preventing fluid from flowing from the lateral passage in the downhole tool to the axial passage using the first seal and the second seal.

21. The method of claim 20, wherein the at least one seal is configured to withstand a pressure difference between an atmospheric pressure in the axial passage and an external wellbore pressure.

22. The method of claim 16 further comprising at least partially sealing the at least one conductor in glass.

23. The method of claim 16 further comprising fixing the body in the tool by seating the body seats between an interior shoulder formed in the downhole tool and a retaining element connected to an interior surface of the downhole tool.

24. The method of claim 16, wherein the opening is aligned laterally relative to the axial bore of the body.

25. method tool of claim 16, further comprising a plurality of circumferentially arrayed openings.

* * * * *